US006224345B1

(12) United States Patent
Dussault

(10) Patent No.: US 6,224,345 B1
(45) Date of Patent: May 1, 2001

(54) PRESSURE/VACUUM GENERATOR

(75) Inventor: Christopher C. Dussault, Bennington, VT (US)

(73) Assignee: Bijur Lubrication Corporation, Bennington, VT (US)

( * ) Notice: Subject to any disclaimer, the term of this patent is extended or adjusted under 35 U.S.C. 154(b) by 0 days.

(21) Appl. No.: 09/273,986

(22) Filed: Mar. 22, 1999

(51) Int. Cl.[7] ..... F04F 1/06; F04F 5/48
(52) U.S. Cl. ..... 417/138; 417/182; 417/182.5
(58) Field of Search ..... 417/138, 182, 417/182.5, 185

(56) References Cited

U.S. PATENT DOCUMENTS

| | | | | |
|---|---|---|---|---|
| 2,400,651 | | 5/1946 | Marsh | 417/120 |
| 2,522,077 | | 9/1950 | Wahl et al. | 414/502 |
| 2,664,911 | | 1/1954 | Thompson et al. | 137/205 |
| 3,315,611 | | 4/1967 | Thompson | 417/131 |
| 3,780,996 | * | 12/1973 | Nutten | 261/72 |
| 3,981,319 | * | 9/1976 | Holt | 137/211 |
| 4,770,610 | | 9/1988 | Breckner | 417/12 |
| 4,828,461 | * | 5/1989 | Laempe | 417/132 |
| 5,007,803 | * | 4/1991 | Divito | 417/137 |
| 5,451,144 | | 9/1995 | French | 417/132 |
| 5,938,408 | * | 8/1999 | Krichbaum | 417/87 |

* cited by examiner

*Primary Examiner*—Timothy S. Thorpe
*Assistant Examiner*—Michael K. Gray
(74) *Attorney, Agent, or Firm*—Caesar, Rivise, Bernstein, Cohen & Pokotilow, Ltd.

(57) ABSTRACT

A pressure/vacuum generator is established by coupling the pressure port of a vacuum generator to an air pressure source while coupling a valve in fluid communication with the exhaust port of the vacuum generator. When the valve is in a normally open condition (i.e, the exhaust vented to atmosphere), the vacuum port of the pressure/vacuum generator generates a vacuum. When the valve is closed, thereby closing off the exhaust port, the vacuum port becomes a pressure port. Thus, this pressure/vacuum generator can be used in any number of fluid (liquid and gas) systems (e.g., fluid recovery system, fluid transfer system, etc.)that require both a pressure source and a vacuum source while using a minimum number of components.

20 Claims, 9 Drawing Sheets

PRESSURE/VACUUM GENERATOR

FIELD OF THE INVENTION

The invention pertains to the field of fluid systems, and more particularly, to systems that require the use of both a pressure source and a vacuum source.

BACKGROUND OF INVENTION

In many fluid systems, there is a need to have both a pressure source (e.g., a pump) as well as a vacuum source (e.g., vacuum pump, vacuum generator, etc.). For example, in fluid recovery systems or fluid transfer systems, there is a need to collect a fluid from a first location (e.g., a main fluid system, a first fluid system, a fluid collection point) and move the fluid into a reservoir and then to evacuate the fluid from that reservoir either back to the main fluid system (i.e., a recovery system) or to a second fluid system (i.e., a transfer system). To accomplish this, a vacuum source draws the fluid into the reservoir and then a pressure source drives it out of the reservoir.

The following U.S. patents are various types of fluid systems using pressure sources and vacuum sources.

U.S. Pat. No. 2,400,651 (Marsh) discloses a liquid elevating system. A summary of the Marsh system 2 is shown in FIG. 1. The Marsh system 2 uses a shuttle valve 4 between an air supply 6, a reservoir 8 and a pressure inlet (P) of a vacuum generator 10, as well as an air-operated valve 12 between the reservoir 8 and a vacuum inlet (V) of the vacuum generator 10. A reservoir inlet check valve 16 and a reservoir outlet check valve 14 are also used. A float mechanism 20 inside the reservoir 8 controls the shuttle valve 4.

U.S. Pat. No. 2,522,077 (Wahl) discloses a tank truck. A summary of the pumping system 34 used in the Wahl truck is shown in FIG. 2. The pumping system 34 uses a pump (P, driven by a motor 36) to draw a vacuum on a reservoir 38 to pull liquid in, and a mechanical screw 40 coupled to another motor 42 to pump it out. Manually-operated input 44 and output 46 valves are also used, as well as an air inlet check valve 48. The system 34 is manually-operated.

U.S. Pat. No. 2,664,911 (Thompson) discloses a portable vacuum and pressure liquid tank truck. A summary of the pumping system 18 of the truck is shown in FIG. 3. The pumping system 18 uses a pump 20 (driven by a motor, M) to draw a vacuum or pressurize a reservoir 22; a separator 24 with a float valve 26 keeps fluid from getting into the pump 20. The pump 20 action (vacuum, or pressure) is based on the position of a valve 28 that is manually controlled. Manually-operated input 30 and output 32 valves are also used.

U.S. Pat. No. 3,315,611 (Thompson) discloses a portable vacuum and pressure liquid tank truck, and uses a pumping system similar to the pumping system disclosed in U.S. Pat. No. 2,664,911 (Thompson) but adds an air bleeder to the system. The bleeder line draws air into the tank along with the liquid during the vacuum stage, thus eliminating foam. During the pressure stage, pressurized air is mixed with the liquid in the tank, making it easier to pump.

U.S. Pat. No. 4,770,610 (Breckner) discloses a frail material slurry pump system 50. A summary of the Breckner system 50 is shown in FIG. 4. This system 50 uses a vacuum pump 52 (driven by a motor M) and combination valving ($V_{P1}$–$V_{P3}$, $V_{V1}$–$V_{V3}$,$BV_I$ and $BV_O$) to pull a vacuum on a reservoir 56 and uses a compressor (not shown, but forms a part of the air supply) with the combination valving ($V_{P1}$–$V_{P3}$, $V_{V1}$–$V_{V3}$, $BV_I$ and $BV_O$) to pressurize the reservoir 56. The $BV_I$ and $BV_O$ valves are a bladder type to prevent damage to the frail material being pumped. This combination valving ($V_{P1}$–$V_{P3}$ with $V_{V1}$–$V_{V3}$) controls the inlet $BV_I$ and outlet $BV_O$ bladder valves of the reservoir 56.

U.S. Pat. No. 4,828,461 (Laempe) discloses an apparatus for metering flowable materials in sand core making machines. A summary of the pumping system 58 used therein is shown in FIG. 5. The pumping system 58 works in a similar manner to the Marsh system 2 (FIG. 1) but includes two shut-off valves, 60 and 62, going into a vacuum generator 64, whereby the shut-off valve 60 is coupled to the pressure port (P) of the vacuum generator 64 and the shut-off valve 62 is coupled to the vacuum port (V) of the vacuum generator 64. In order to pressurize a reservoir 66, the pumping system 58 uses a third shutoff valve 68 (for dividing the air supply, while closing the upper shut-off valve 60). Reservoir inlet 70 and outlet 72 check valves are also used with the reservoir 66.

U.S. Pat. No. 5,451,144 (French) discloses an air-operated pump system 76. A summary of this pump system 76 is shown in FIG. 6. The system 76 primarily uses gravity to draw liquid in, whereby a vaccum (V) is available as an option to assist gravity. The system 76 utilizes two sources of air pressure: a main air supply 78 and an auxiliary air supply 80, the latter of which is fed to a reservoir 84 via flow restrictor 82. Two poppet valves 86 and 88 are used. An air-operated three-way valve 90 is controlled by the poppet valves 86 and 88. A quick-exhaust valve 92 is coupled between the three-way valve 90 and the reservoir 84. Inlet 94 and outlet 96 check valves are also used with the reservoir 84.

However, none of these references teach or suggest controlling the exhaust port of a vacuum generator for creating both a pressure source and a vacuum source.

OBJECTS OF THE INVENTION

Accordingly, it is the general object of this invention to provide an invention that overcomes the disadvantages of the prior art.

It is an object of the present invention to provide an apparatus, and a method for an apparatus, that can act as both a pressure source and a vacuum source.

It is an object of the present invention to provide an apparatus, and a method for an apparatus, that can act as both a pressure source and a vacuum source while utilizing a minimum number of components.

It is still yet a further object of the present invention to provide any liquid or gas system/method with an apparatus, and a method for an apparatus, that can act as both a pressure source and a vacuum source.

It is yet another object of the present invention to provide fluid recovery/transfer systems that utilize a minimum number of components.

It is still yet a further object of the present invention to provide fluid recovery/transfer systems that are less prone to problems.

SUMMARY OF THE INVENTION

These and other objects of the instant invention are achieved by providing, in a system requiring both a pressure source and a vacuum source, an improvement comprising: (a) a lumen (e.g., a Venturi tube) for conveying an air stream from an upstream port of the lumen toward a downstream port of the lumen wherein the lumen includes an orifice in the surface of the lumen located between the upstream port and the downstream port and wherein the upstream port is coupled to an air pressure source (e.g., 70–150 psi air supply); (b) a valve coupled in fluid communication with the downstream port for opening and closing off the downstream port; and (c) the orifice pulling a vacuum whenever the valve is open and the orifice generating a positive pressure whenever the valve is closed.

These and other objects of the instant invention are also achieved by providing, in a system for recovering or transferring fluid from a first location to a second location, an improvement comprising: (a) a lumen (e.g., a Venturi tube) for conveying an air stream from an upstream port of the lumen toward a downstream port of the lumen wherein the lumen includes an orifice in the surface of the lumen located between the upstream port and the downstream port and wherein the upstream port is coupled to an air pressure source (e.g., 70–150 psi air supply); (b) a valve coupled in fluid communication with the downstream port for opening and closing off the downstream port; (c) a reservoir having a first port coupled in fluid communication to the orifice; and (d) wherein the orifice pulls a vacuum in the reservoir for drawing fluid from the first location through a second reservoir port whenever the valve is open and wherein the orifice pressurizes the reservoir to evacuate the fluid therein to the second location through a third reservoir port whenever the valve is closed.

These and other objects of the instant invention are also achieved by providing an automatic fluid recovery system for recovering fluid from a main fluid system having at least one escape point (e.g., a leak point, a collection point for accumulating fluid, etc.) and returning the escaping fluid to the main system. The fluid recovery system comprises: (a) a reservoir for collecting the escaping fluid and having a plurality of ports; (b) a first valve coupled in fluid communication between a first port of the reservoir and the at least one escape point; (c) a lumen (e.g., a Venturi tube) for conveying an air stream from an upstream port of the lumen toward a downstream port of the lumen wherein the lumen includes an orifice in the surface of the lumen located between the upstream port and the downstream port and wherein the upstream port is coupled to an air pressure source (e.g., 70–150 psi air supply); (d) a second valve coupled in fluid communication to the downstream port of the lumen; (e) controller means electrically coupled to the first valve and to the second valve; (f) means responsive to the level of the fluid collected in the reservoir and electrically coupled to the controller means for providing electrical signals indicative of the level of the fluid in the reservoir to the controller means; and (g) wherein the controller means controls the activation of the first valve and the second valve, based on the electrical signals, to fill the reservoir and then to evacuate the reservoir and wherein the evacuated fluid is returned to the main fluid system via a check valve coupled in fluid communication with a third port of the reservoir. These and other objects of the instant invention are also achieved by providing a automatic fluid transfer system for transferring fluid from at least one source fluid system having a predictable (e.g., predetermined, constant, etc.) flow to a destination fluid system. The fluid transfer system comprises: (a) a reservoir for receiving fluid from the at least one source fluid system and having a plurality of ports; (b) a first valve coupled in fluid communication between a first port of the reservoir and the at least one source fluid system; (c) a lumen (e.g., a Venturi tube) for conveying an air stream from an upstream port of the lumen toward a downstream port of the lumen wherein the lumen includes an orifice in the surface of the lumen located between the upstream port and the downstream port and wherein the upstream port is coupled to an air pressure source (e.g., 70–150 psi air supply); (d) a second valve coupled in fluid communication to the downstream port of the lumen; (e) controller means electrically coupled to the first valve and to the second valve; and (f) wherein the controller means controls the activation of the first valve and second valve to collect fluid from the at least one source fluid system into the reservoir and then to evacuate the reservoir, whereby the evacuated fluid is transferred to the destination fluid system via a check valve coupled in fluid communication with a third port of the reservoir.

These and other objects of the instant invention are also achieved by providing a method for establishing a pressure source and a vacuum source. The method comprises the steps of: (a) providing an air pressure source (e.g., 70–150 psi air supply) that delivers an air stream; (b) coupling a lumen (e.g., a Venturi tube) to the air pressure source whereby the lumen conveys the air stream from an upstream port of the lumen toward a downstream port of the lumen and wherein the lumen includes an orifice in the surface of the lumen located between the upstream port and the downstream port; (c) coupling a valve in fluid communication with the downstream port for opening and closing off the downstream port; (d) opening the valve to create a vacuum source at the orifice; and (e) closing the valve to create a pressure source at the orifice.

These and other objects of the instant invention are also achieved by providing a method for recovering or transferring fluid from a first location to a second location. The method comprises the steps of: (a) providing an air pressure source (e.g., 70–150 psi air supply) that delivers an air stream; (b) coupling a lumen (e.g., a Venturi tube) to the air pressure source whereby the lumen conveys the air stream from an upstream port of the lumen toward a downstream port of the lumen and wherein the lumen includes an orifice in the surface of the lumen located between the upstream port and the downstream port; (c) coupling a valve in fluid communication with the downstream port for opening and closing off the downstream port; (d) coupling a first port of a reservoir in fluid communication with the orifice; (e) opening the valve to draw fluid from the first location into the reservoir through a second reservoir port; and (f) closing the valve to evacuate the fluid in the reservoir to the second location through a third reservoir port.

These and other objects of the present invention are also achieved by providing a method for recovering escaping fluid (e.g., leaking fluid, accumulating fluid, etc.) from at least one escape point (e.g., a leak point, a collection point where accumulating fluid gathers) in a main fluid system and returning the escaping fluid thereto. The method comprises the steps of: (a) providing an air pressure source (e.g., 70–150 psi air supply) that delivers an air stream; (b) coupling a lumen (e.g., a Venturi tube) to the air pressure source whereby the lumen conveys the air stream from an upstream port of the lumen toward a downstream port of the lumen and wherein the lumen includes an orifice in the surface of the lumen located between the upstream port and the downstream port; (c) coupling a first valve in fluid communication with the downstream port for opening and closing off the downstream port; (d) coupling a first port of a reservoir in fluid communication with the orifice; (e) coupling a second port of the reservoir in fluid communication with a second valve that is in fluid communication with the at least one escape point; and (f) controlling the operation of the first valve and the second valve to collect escaping fluid in the reservoir through the second port and then to return the collected fluid to the main fluid system through a third reservoir port.

These and other objects of the present invention are also achieved by providing a method for transferring fluid from at least one source fluid system having a predictable flow to a destination fluid system. The method comprises the steps of: (a) providing an air pressure source (e.g., 70–150 psi air supply) that delivers an air stream; (b) coupling a lumen (e.g., a Venturi tube) to the air pressure source whereby the lumen conveys the air stream from an upstream port of the lumen toward a downstream port of the lumen and wherein the lumen includes an orifice in the surface of the lumen located between the upstream port and the downstream port; (c) coupling a first valve in fluid communication with the downstream port for opening and closing off the downstream port; (d) coupling a first port of a reservoir in fluid communication with the orifice; (e) coupling a second port of the reservoir in fluid communication with a second valve that is in fluid communication with the at least one source fluid system; and (f) controlling the operation of the first valve and the second valve to collect fluid from the at least one source fluid system into the reservoir through the second port and then to transfer the collected fluid to the destination fluid system through a third reservoir port.

DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
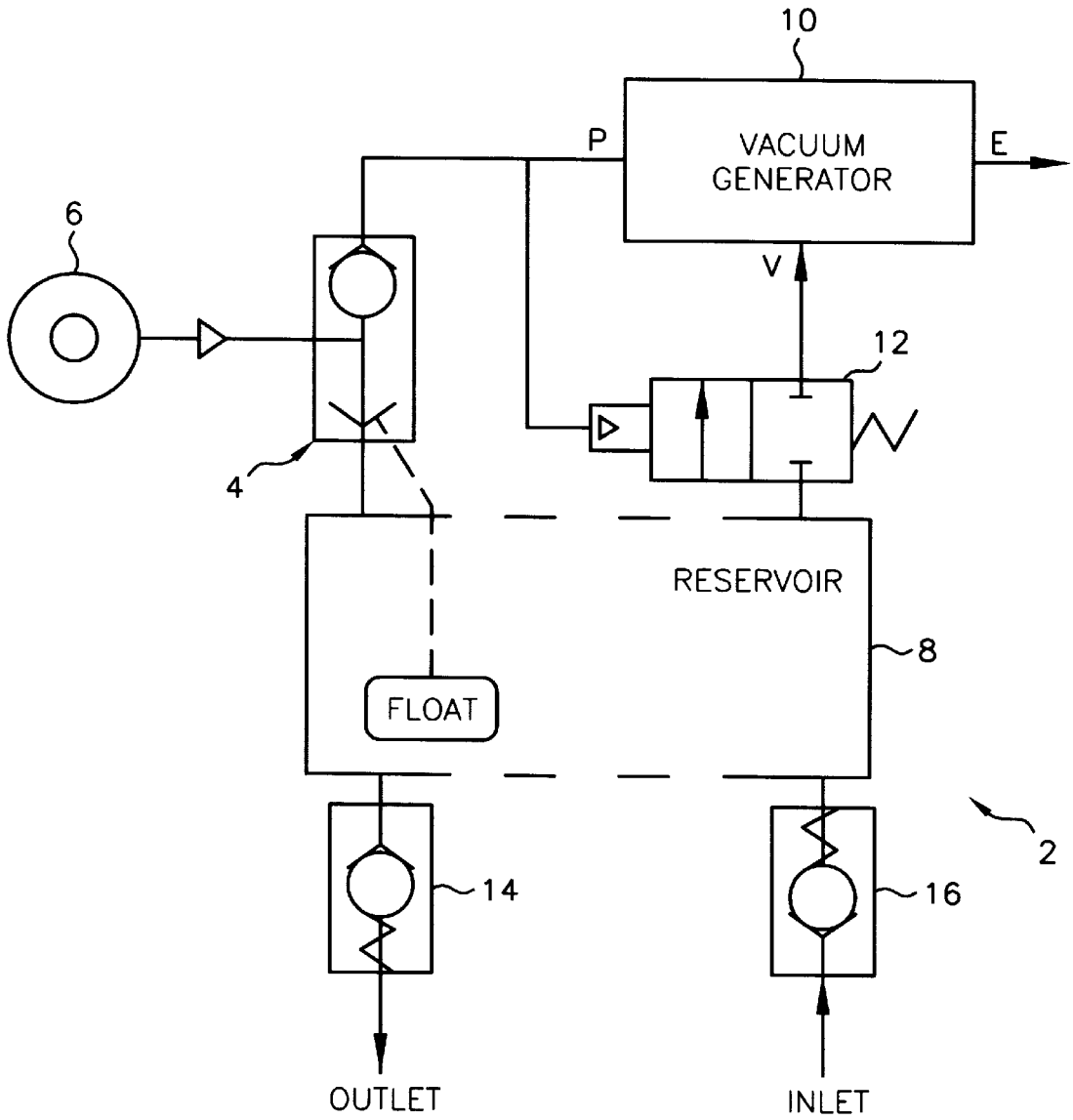
FIG. 1 (Prior Art)
FIG. 1 is a summary of a prior art pumping system, namely U.S. Pat. No. 2,400,651 (Marsh)
Figure 2:
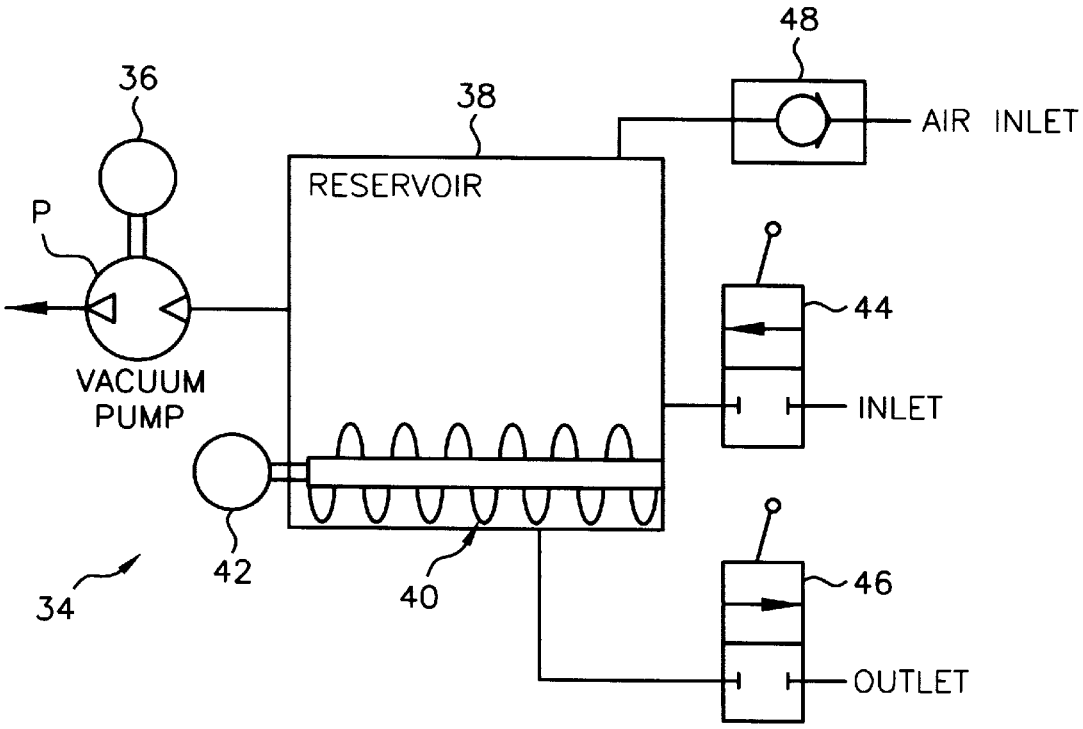
FIG. 2 (Prior Art)
FIG. 2 is a summary of another prior art pumping system, namely U.S. Pat. No. 2,522,077 (Wahl)
Figure 3:
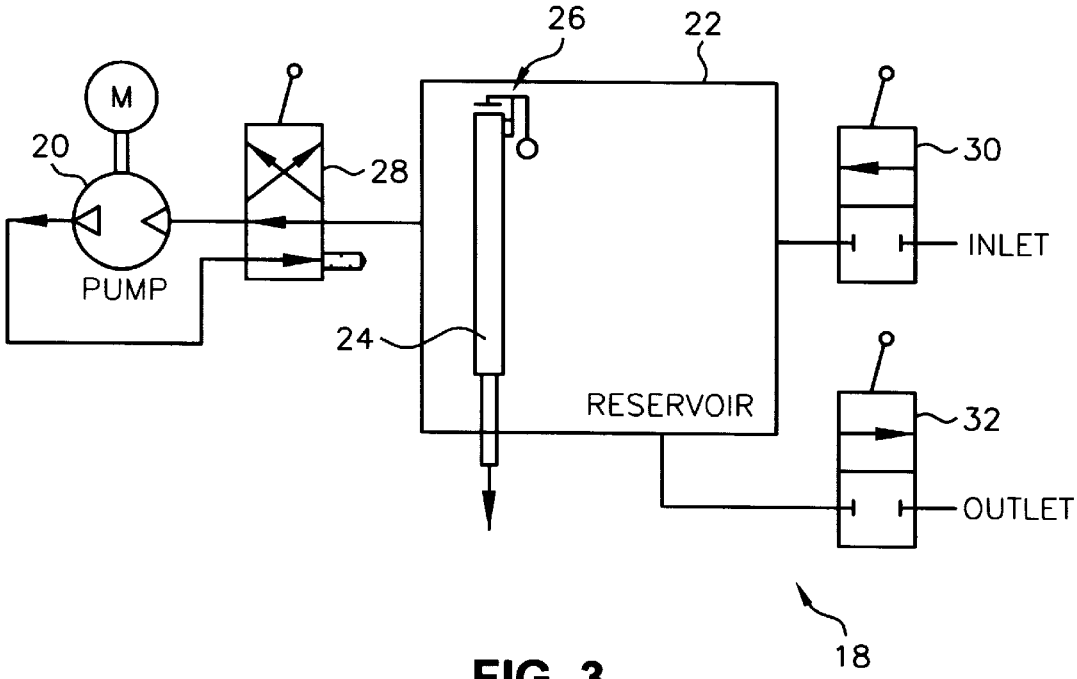
FIG. 3 (Prior Art)
FIG. 3 is a summary of another prior art pumping system, namely U.S. Pat. No. 2,664,911 (Thompson)
Figure 4:
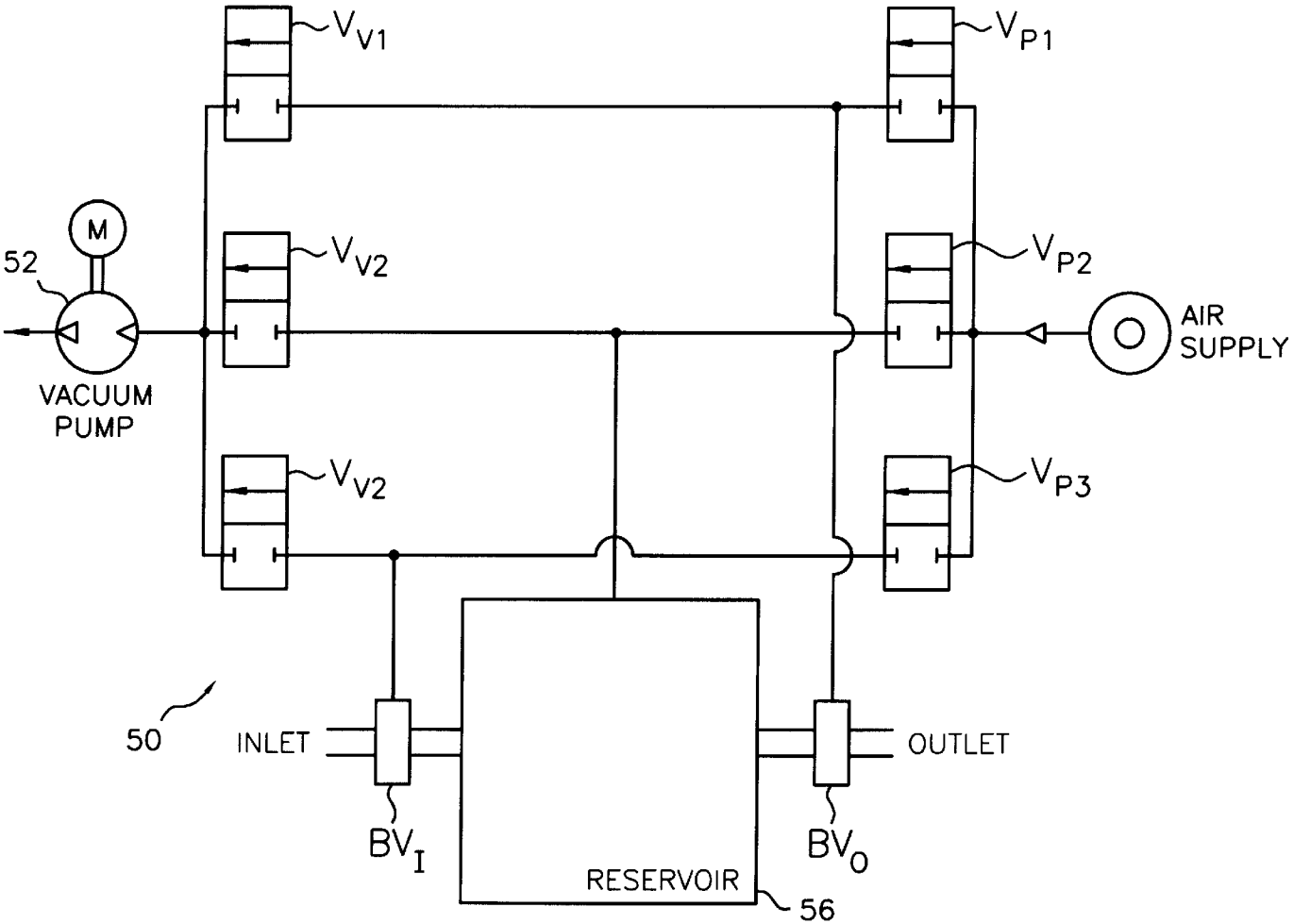
FIG. 4 (Prior Art)
FIG. 4 is a summary of another prior art pumping system, namely U.S. Pat. No. 4,770,610 (Breckner)
Figure 5:
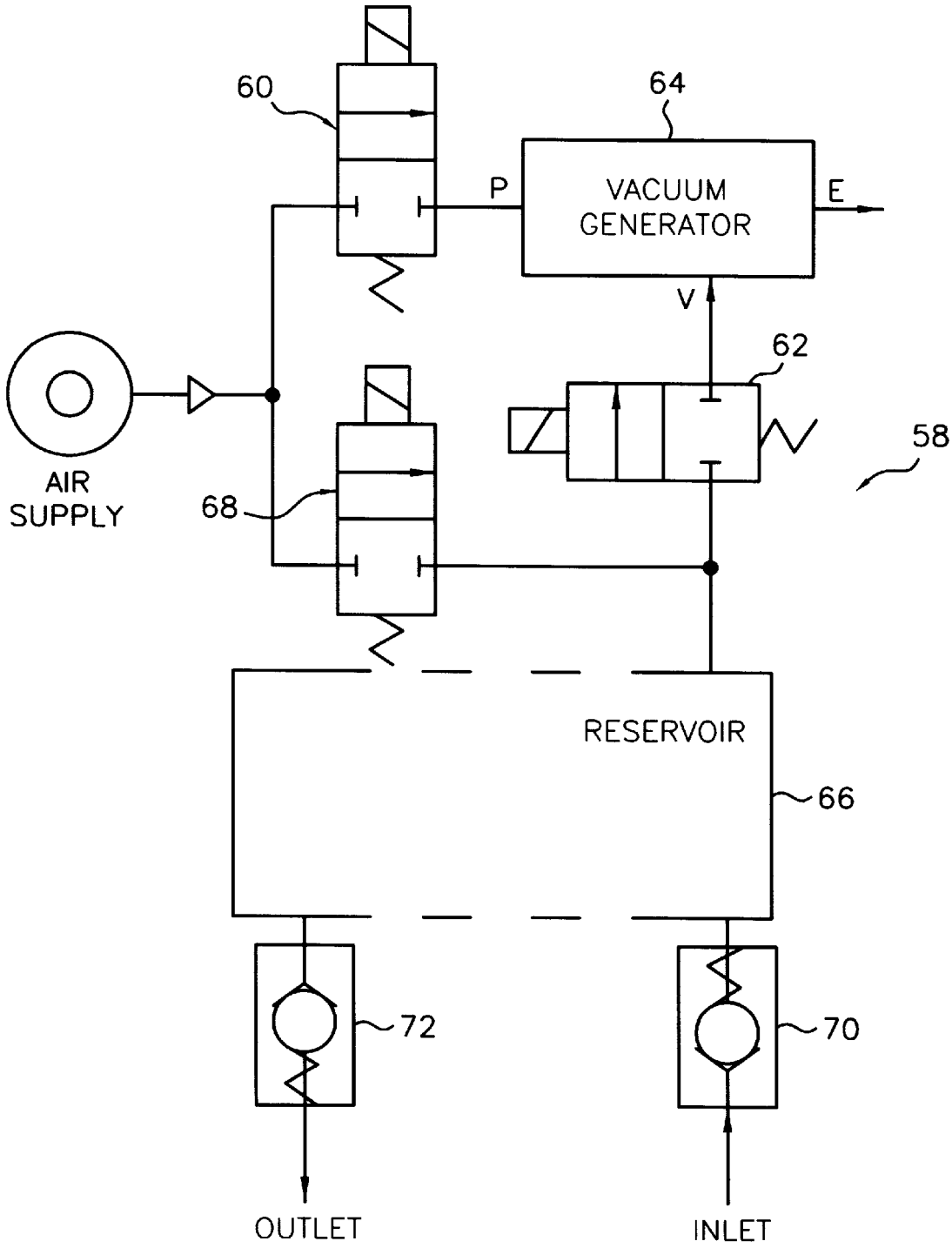
FIG. 5 (Prior Art)
FIG. 5 is a summary of another prior art pumping system, namely U.S. Pat. No. 4,828,461 (Laempe)
Figure 6:
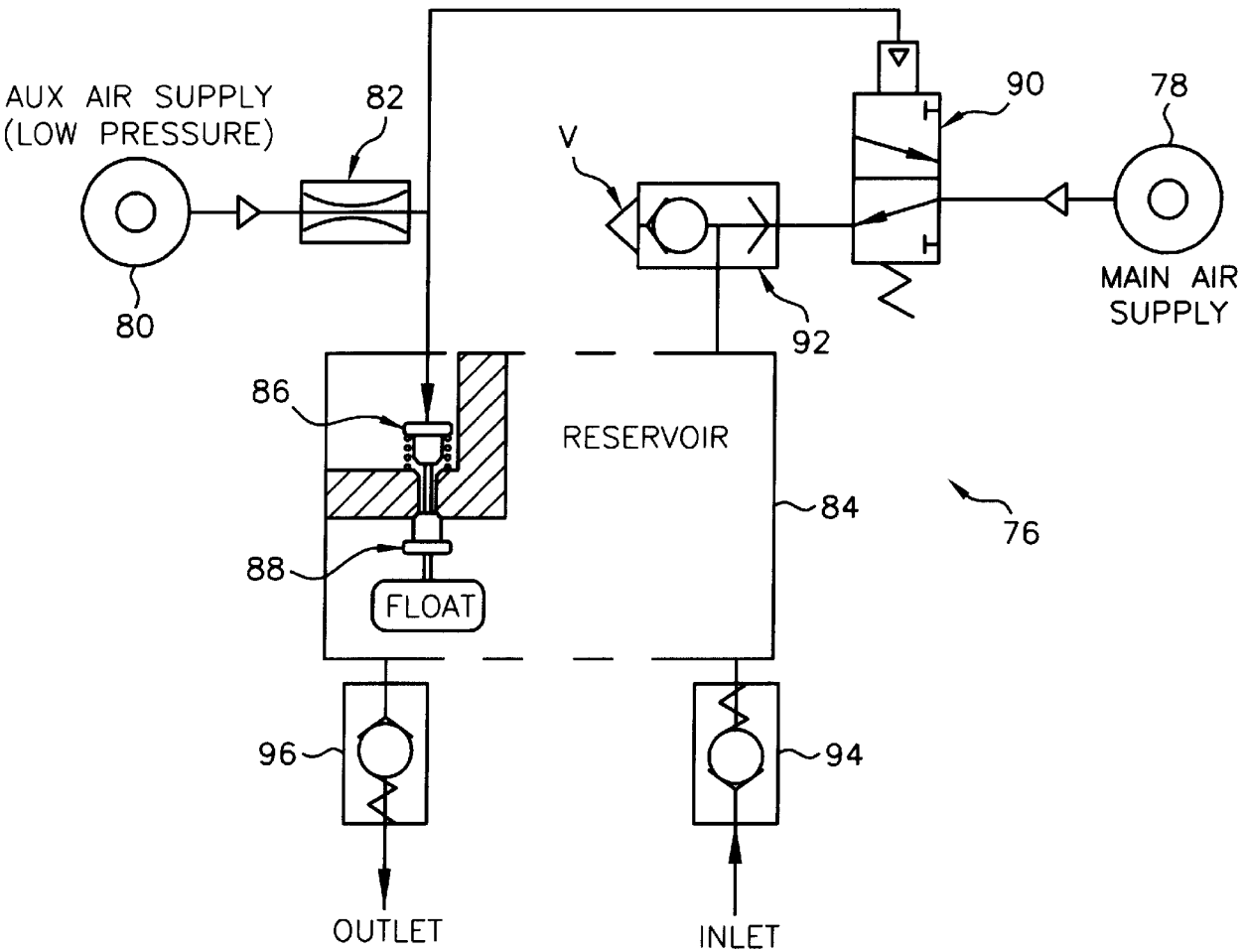
FIG. 6 (Prior Art)
FIG. 6 is a summary of another prior art pumping system, namely U.S. Pat. No. 5,451,144 (French)
Figure 7:
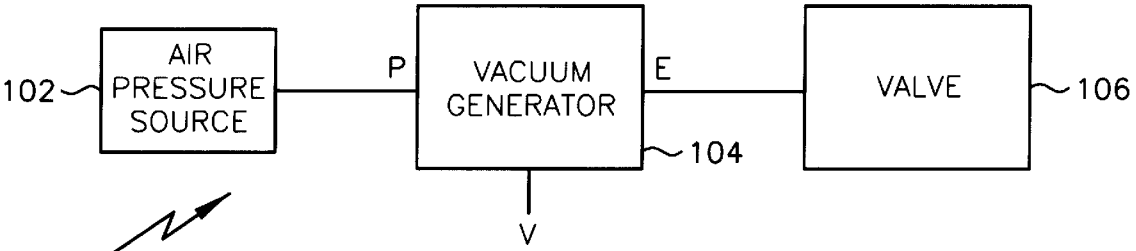
FIG. 7 is a block diagram of the present invention.

Referring now in detail to the various figures of the drawing wherein like reference characters refer to like parts, there is shown at 100 in FIG. 7 a pressure/vacuum generator, which is assigned to Bijur Lubricating Corporation of Bennington, Vt.

Figure 8:
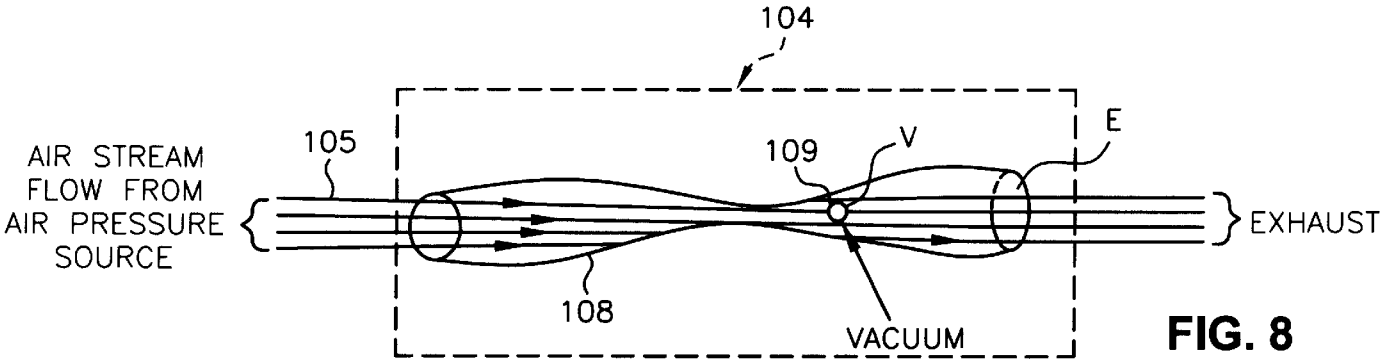
FIG. 8 is a functional diagram of the present invention with the exhaust port being in an open condition.
Figure 9:
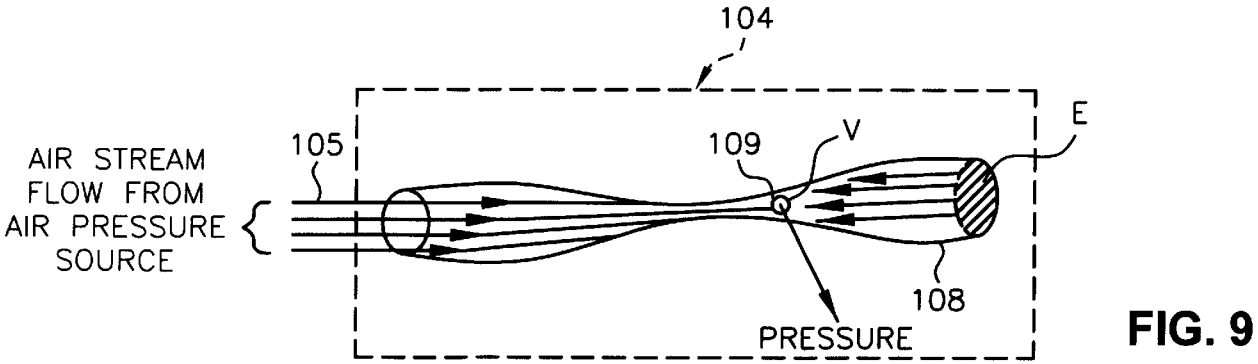
FIG. 9 is a functional diagram of the present invention with the exhaust port in a closed condition.

The pressure/vacuum generator 100 comprises an air pressure source 102 (e.g., 70–150 psi air supply), a vacuum generator 104 (e.g., Bijur Part No. 27296) and a valve 106 (Bijur Part No. 27299). The air pressure source 102 is coupled to the pressure port (P) of the vacuum generator 104 and the valve 106 is coupled to the exhaust port (E) of the vacuum generator 104. The valve 106 acts to either permit the exhaust port to be open to the atmosphere or to be closed to the atmosphere. FIGS. 8 and 9 are functional diagrams of the vacuum generator 104 with the valve 106 open (FIG. 8) and with the valve 106 closed (FIG. 9). As can be seen in FIGS. 8 and 9, the vacuum generator 104 basically comprises a Venturi tube 108; the vacuum port V comprises a small orifice 109 located just right of the center of the Venturi tube 108. When the valve 106 is open and the air pressure source 102 is coupled to the pressure port (P) of the vacuum generator 104, the air stream 105 creates a vacuum at the vacuum port V in accordance with the Bernoulli principle. However, when the valve 106 is closed, thereby blocking the exhaust port (E), the air stream 105 is forced through the small orifice 109, thereby generating a positive pressure at the vacuum port V. None of the prior art teaches or suggests the control of the vacuum generator's 104 exhaust to establish both a pressure source and a vacuum source.

Figure 10:
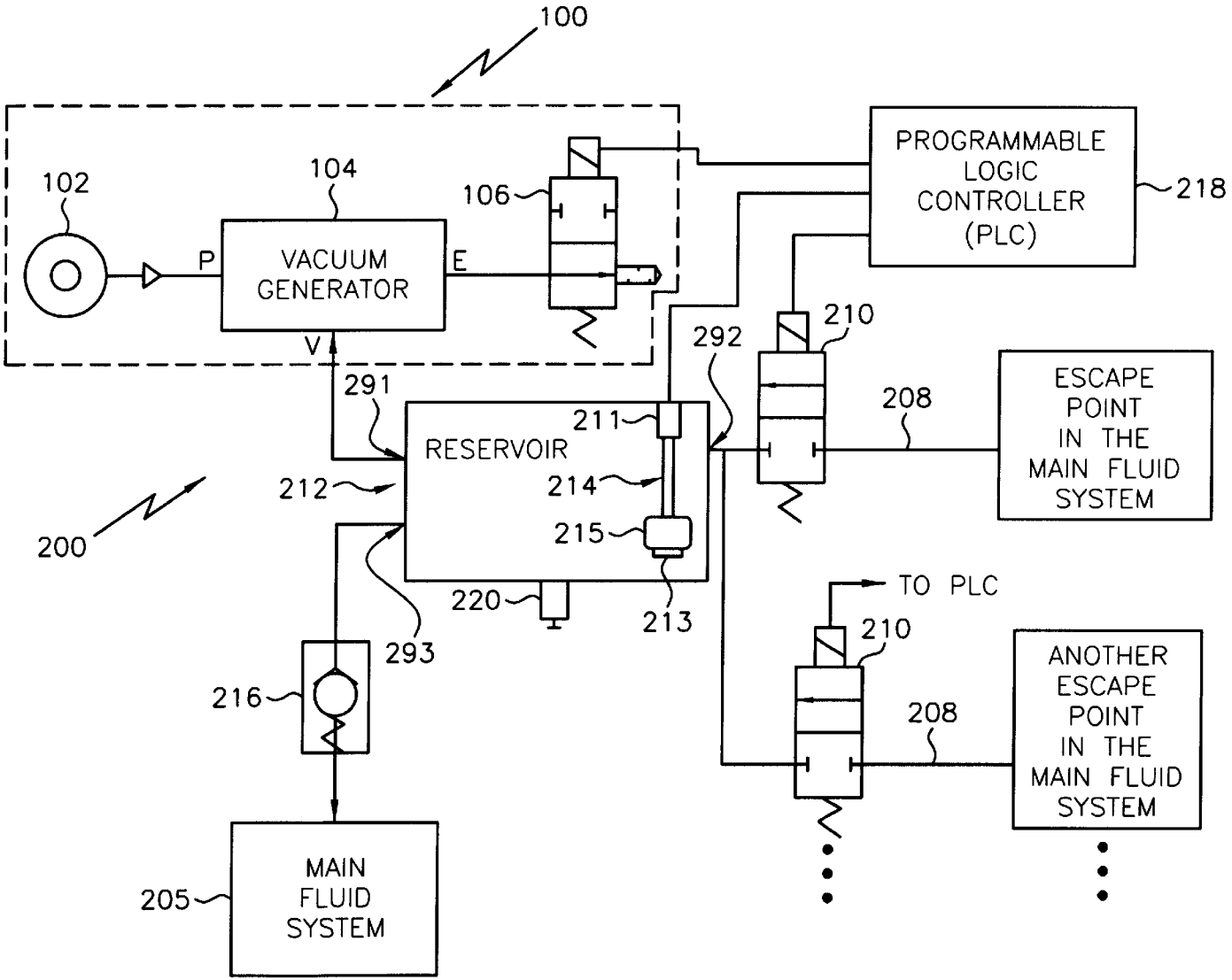
FIG. 10 is a block diagram of a first exemplary application of the present invention, known as a fluid recovery system (FRS)

An exemplary application of the pressure/vacuum generator is shown in FIG. 10 which depicts a fluid recovery system (hereinafter "FRS") 200. The FRS 200 is used as part of a main fluid system. The main fluid system (e.g., a lubrication system) comprises any number of devices that may be prone to leaks, including tubing, connectors, elbows, flanges, bearings, seals, gaskets, etc. (all of which are not shown). It is necessary to capture the leaking fluid and return it to the main fluid system.

Furthermore, in addition to restoring leaking fluid to a main fluid system, the FRS 200 also restores accumulated fluid back to the main fluid system. For example, the main fluid system in a punch press machine may intentionally overlubricate the slides/ways of the machine. As a result, an accumulation of that lubricant occurs at an accumulation point or a collection point (e.g., a collection tray). The FRS 200, being coupled to the accumulation/collection point, also restores the accumulated fluid back to the main fluid system. Thus, it is within the broadest scope of the FRS 200 that the term "escape", "escaping", etc. as used throughout this application covers both leaking fluid (i.e., unintentional egress of fluid from the main fluid system) and accumulating fluid (i.e., intentional egress of fluid, at an accumulation point or a collection point, from the main fluid system) which cannot otherwise re-enter the main fluid system without the FRS 200.

The escaping fluid is captured in a conduit, lumen, collection tray, etc. (indicated by reference number 208) that is connected to, or around, these escape points (not shown). This conduit 208 is in fluid connection with the inlet to the FRS 200. In particular, the conduit 208 is coupled to a vacuum valve 210 (e.g., Bijur Part Nos. 27300/27310). The vacuum valve 210 has an outlet coupled to a reservoir 212 (e.g., Bijur Part No. 27275). At a resevoir part 292 the reservoir 212 comprises a means 214 responsive to the level of the fluid being collected in the reservoir 212; an example of such a means is an ultrasonic level detector (not shown), or any other type of level detection that provides a signal responsive to the level. In one embodiment, a liquid dual-level switch (e.g., Bijur Part No. 27301, 24 volts DC switch, 0.5 $amps_{max}$) is used. The liquid dual-level switch comprises an upper switch 211, a lower switch 213 and a magnetic float 215; when the reservoir 212 is empty, the magnetic float 215 and the lower switch 213 are electromagnetically coupled, and the lower switch 213 outputs an "empty" signal; when the reservoir 212 is full, the magnetic float 215 and the upper switch 211 are electromagnetically coupled, and the upper switch 211 outputs a "full" signal. The reservoir 212, at another reservoir port 291 is also in fluid communication with the vacuum port (V) of the vacuum generator 104. The reservoir 212, at another port 293 is also in fluid communication with an outlet check valve 216 (e.g., Bijur Part No. 27302). The outlet check valve 216 is in fluid communication with the main fluid system. A programmable logic controller (PLC) 218 (e.g., IDEC Micro-1 PLC, Type FC1A4E, Base 24 manufactured by IDEC Izumi Corp. of Japan, or any properly configured logic device, e.g., a microprocessor, a microcontroller, etc.) is electrically coupled to the solenoids of the vacuum valve 210 and the valve 106), as well as to the means 214 responsive to the level of the fluid being collected (hereinafter the "level means 214") in the reservoir 212. A drain 220 is provided in the reservoir 212 for maintenance purposes.

Operation of the FRS 200 is as follows. To collect escaping fluid from the escape point(s), the PLC 218 de-energizes the valve 106 (thereby opening the valve to permit exhaust) while energizing the vacuum valve 210 (opening the valve 210). This action causes a vacuum to be drawn in the reservoir 212. The result is that escaping fluid from the main fluid system is drawn into the reservoir 212 through the vacuum valve 210. As fluid is drawn in and when the fluid level causes the magnetic float 215 to be adjacent the upper switch 211, the liquid dual-level switch outputs the "full" signal to the PLC 218, thereby causing the PLC 218 to de-energize the vacuum valve 210 (closing the vacuum valve 210) while energizing the valve 106. Energizing the valve 106, closes off the exhaust port, E, of the vacuum generator 104 which, as discussed above, converts the vacuum port, V, into a pressure port. This action pushes the collected fluid out of the reservoir 212, through the outlet check valve 216 and back to the main fluid system 205 (or even to a liquid waste container, not shown). As the fluid leaves the reservoir 212, the magnetic float 215 falls; when the magnetic float 215 is adjacent to the lower switch 213, the "empty" signal is transmitted to the PLC 218 which then de-energizes the valve 106 and re-energizes the vacuum valve 210. This cycle is then repeated.

It should be understood that a plurality of conduits, lumens, collection points, etc. (indicated by reference number 208) from various escape points in the main fluid system, each with a respective vacuum valve 210, can be coupled to the reservoir 212; each vacuum valve 210 is also electrically coupled to the PLC 218. Thus, the PLC 218 can control each vacuum valve 210 in sequence (e.g., activate one vacuum valve 210 for 10 seconds while keeping all other vacuum valves 210 closed; then shutting off that vacuum valve while opening another vacuum valve 210, and repeating the cycle).

Figure 11:
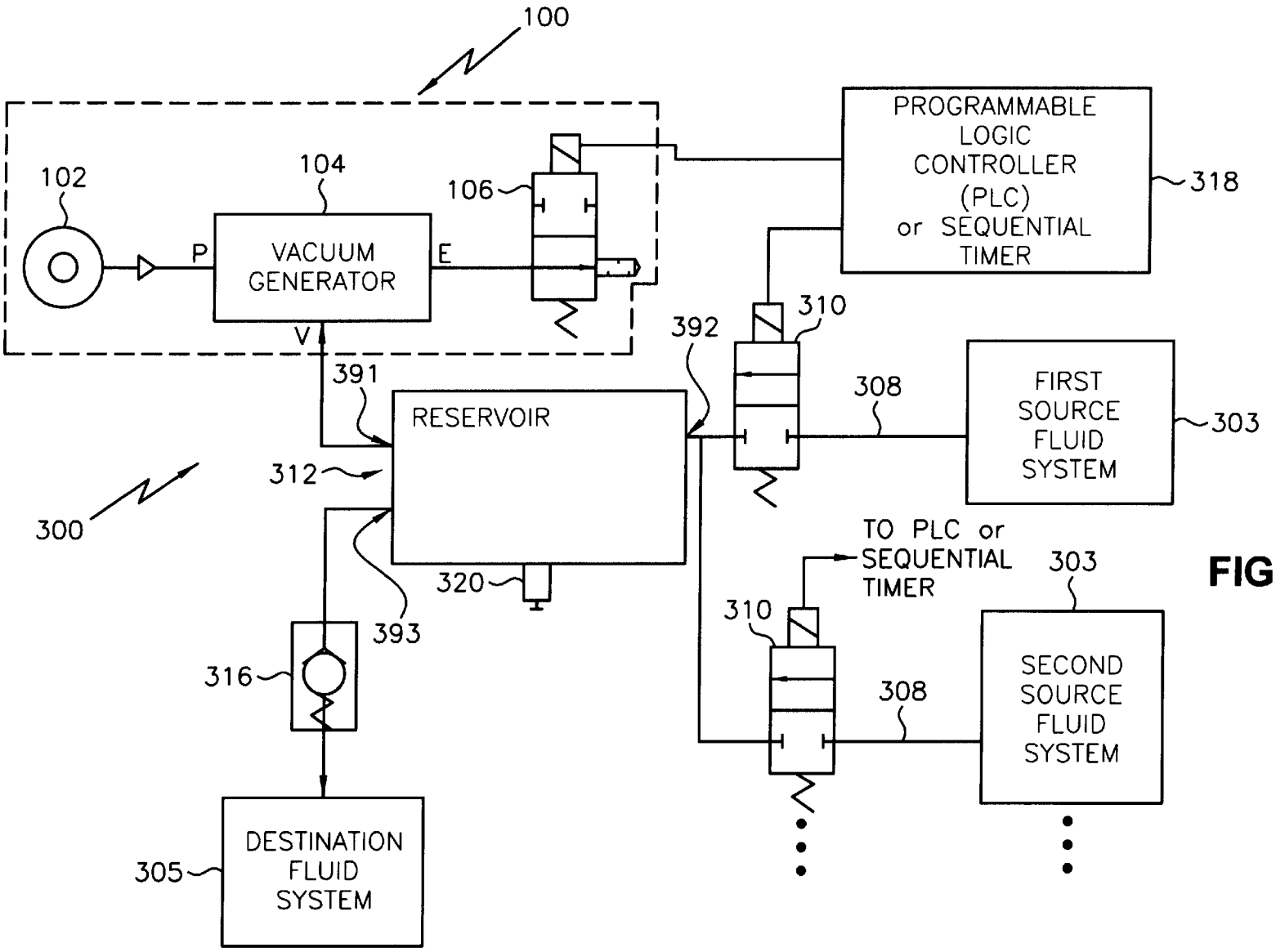
FIG. 11 is a block diagram of a second exemplary application of the present invention, known as a fluid transfer system (FTS).

It should also be understood that only a single pressure/vacuum generator 100 and reservoir (e.g., reservoir 212 or 312) are required to service a multiplicity of vacuum valves (e.g., vacuum valves 210 or 310), as shown in FIGS. 10–11.

It should also be understood that the level means 214 in the FRS 200 covers all types of mechanisms that couple the level of the fluid collected in the reservoir 212 to the valve 106 and the vacuum valve 210. In other words, as shown, the level means 214 provides an electrical signal to the PLC 218 which, in turn, controls the respective solenoids of the valve 106 and the vacuum valve 210 at the appropriate times. However, it is within the broadest scope of the FRS 200 that the level means 214 includes a direct interface with the valve 106 and the vacuum valve 210 so that movement of the level means 214 closes/opens the valve 106 while closing/opening the vacuum valve 210.

Another exemplary application of the pressure/vacuum generator is shown in FIG. 11 which depicts an automatic fluid transfer system (hereinafter "FTS" 300). The FTS 300 is similar to the FRS 200, except that the FTS 300 involves transferring a source fluid from a source fluid system 303, having a predictable (e.g., predetermined, constant, etc.) flow, to a destination fluid system 305. Since the flow of the source fluid system 303 is predictable, there is no need to monitor the level of the fluid collecting in the reservoir 312. As a result, the PLC 318 (or sequential timer, or other timing devices) can operate on a timing basis rather than having to sense the reservoir 312 fluid level. Other than that, the components of the FTS 300 correspond to the components of the FRS 200, whereby the reference numbers beginning with "3—" are the same for those reference numbers beginning with "2—". Furthermore, as shown in FIG. 11, the FTS 300 can operate using a plurality of source fluid systems 303 (each having a predictable, e.g., predetermined, constant, etc., flow) for transferring source fluids from each of their respective source fluid systems to the destination fluid system 305.

The important aspect of the pressure/vacuum generator 100 is the automatic valving of the exhaust port, E, of the vacuum generator 104. Valving the exhaust port permits the use of a single source to act as both the "puller" and "pusher" of a fluid while using only a single valve (106). This increases the reliability of any system (e.g., the FRS 200/FTS 300) which uses the pressure/vacuum generator 100 by decreasing the number of components that can fail while reducing the cost of the fluid systems' operation. Thus, it should be understood that the present invention 100 has an unlimited number of applications and that the FRS 200 and the FTS 300 discussed above are only by way of example.

It should be understood that the term "fluid" used throughout the present application includes both liquids and gases and therefore the pressure/vacuum generator 100, as well as the FRS 200 and FTS 300, discussed above, can all be implemented for gas systems also. In addition, the term "automatic" used throughout the present application identifies that there is no manual operation involved in order for the FRS 200 or the FTS 300 to operate.

It should also be understood that where the valves depicted in the present application use electric solenoid control, other types of control (e.g., pneumatically-controlled valves) are also covered by the broadest scope of this invention.

Without further elaboration, the foregoing will so fully illustrate my invention that others may, by applying current or future knowledge, readily adopt the same for use under various conditions of service.

I claim:

1. In a system for recovering or transferring fluid from a first location to a second location, the improvement comprising:

(a) a lumen for conveying an air stream from an upstream port of said lumen toward a downstream port of said lumen, said lumen including an orifice in the surface of said lumen located between said upstream port and said downstream port, said upstream port being coupled to an air pressure source;

(b) a valve coupled in fluid communication with said downstream port for opening and closing off said downstream port;

(c) a reservoir having a first port coupled to said orifice; and (d) said orifice pulling a vacuum in said reservoir for drawing fluid from the first location through a second reservoir port whenever said valve is open and said orifice pressurizing said reservoir to evacuate the fluid therein to the second location through a third reservoir port whenever said valve is closed, said lumen not being exposed to the fluid.

2. The improvement of claim 1 wherein said lumen comprises a Venturi tube.

3. An automatic fluid recovery system for recovering fluid from a main fluid system having at least one escape point and returning the escaping fluid to the main system, said fluid recovery system comprising:

(a) a reservoir for collecting the escaping fluid and having a first port, a second port and a third port;

(b) a first valve coupled in fluid communication between said first port of said reservoir and the at least one escape point;

(c) a lumen for conveying an air stream from an upstream port of said lumen toward a downstream port of said lumen, said lumen including an orifice in the surface of said lumen located between said upstream port and said downstream port, said upstream port being coupled to an air pressure source, and said orifice being coupled to said second reservoir port, said lumen not being exposed to the fluid;

(d) a second valve coupled in fluid communication to said downstream port of said lumen;

(e) controller means electrically coupled to said first valve and to said second valve;

(f) means responsive to the level of the fluid collected in said reservoir electrically coupled to said controller means for providing electrical signals indicative of the level of the fluid in said reservoir to said controller means; and (g) wherein said controller means controls the activation of said first valve and said second valve, based on said electrical signals, to fill said reservoir and then to evacuate said reservoir, said evacuated fluid being returned to said main fluid system via a check valve coupled in fluid communication with said third port of said reservoir.

4. The fluid recovery system of claim 3 wherein said first valve is normally closed and is opened when activated by said controller means.

5. The fluid recovery system of claim 3 wherein said second valve is normally open and is closed when activated by said controller means.

6. The fluid recovery system of claim 3 wherein said lumen comprises a Venturi tube.

7. The fluid recovery system of claim 3 wherein said level detecting means responsive to said level of the fluid collected in said reservoir is a fluid dual-level switch that comprises:

(a) float portion that floats on the fluid collected in said reservoir;

(b) an upper switch portion which, when electromagnetically coupled to said float portion, generates a first electrical signal to said controller means indicative of a full reservoir; and (c) a lower switch portion which, when electromagnetically coupled to said float portion, generates a second electrical signal to said controller means indicative of an empty reservoir.

8. An automatic fluid transfer system for transferring fluid from at least one source fluid system having a predictable flow to a destination fluid system, said fluid transfer system comprising:

(a) a reservoir for receiving fluid from the at least one source fluid system and having a first port, a second port and a third port;

(b) a first valve coupled in fluid communication between said first port of said reservoir and the at least one source fluid system;

(c) a lumen for conveying an air stream from an upstream port of said lumen toward a downstream port of said lumen, said lumen including an orifice in the surface of said lumen located between said upstream port and said downstream port, said upstream port being coupled to an air pressure source, and said orifice being coupled to said second reservoir port;

(d) a second valve coupled in fluid communication to said downstream port of said lumen;

(e) controller means electrically coupled to said first valve and to said second valve; and (f) wherein said controller means controls the activation of said first valve and said second valve to collect fluid from the at least one source fluid system into said reservoir and then to evacuate said reservoir, said evacuated fluid being transferred to the destination fluid system via a check valve coupled in fluid communication with said third port of said reservoir, said lumen not being exposed to the fluid.

9. The fluid recovery system of claim 8 wherein said first valve is normally closed and is opened when activated by said controller means.

10. The fluid recovery system of claim 8 wherein said second valve is normally open and is closed when activated by said controller means.

11. The fluid recovery system of claim 8 wherein said lumen comprises a Venturi tube.

12. A method for recovering or transferring fluid from a first location to a second location, said method comprising the steps of:

(a) providing an air pressure source that delivers an air stream;

(b) coupling a lumen to said air pressure source, said lumen conveying said air stream from an upstream port of said lumen toward a downstream port of said lumen, said lumen including an orifice in the surface of said lumen located between said upstream port and said downstream port;

(c) coupling a valve in fluid communication with said downstream port for opening and closing off said downstream port;

(d) coupling a first port of a reservoir to said orifice without exposing said lumen to the fluid;

(e) opening said valve to draw fluid from the first location into said reservoir through a second reservoir port; and (f) closing said valve to evacuate the fluid in said reservoir to the second location through a third reservoir port.

13. The method of claim 12 wherein said lumen comprises a Venturi tube.

14. A method for recovering escaping fluid from at least one escape point in a main fluid system and returning the escaping fluid thereto, said method comprising the steps of:

(a) providing an air pressure source that delivers an air stream;

(b) coupling a lumen to said air pressure source, said lumen conveying said air stream from an upstream port of said lumen toward a downstream port of said lumen, said lumen including an orifice in the surface of said lumen located between said upstream port and said downstream port;

(c) coupling a first valve in fluid communication with said downstream port for opening and closing off said downstream port;

(d) coupling a first port of a reservoir to said orifice without exposing said lumen to the fluid;

(e) coupling a second port of said reservoir in fluid communication with a second valve that is in fluid communication with the at least one escape point; and (f) controlling the operation of said first valve and said second valve to collect escaping fluid in said reservoir through said second port and then to return the collected fluid to the main fluid system through a third reservoir port.

15. The method of claim 14 wherein said step of controlling the operation of said first valve and said second valve comprises:

(a) opening said first and second valves to draw fluid from the at least one escape point into said reservoir through said second reservoir port;

(b) detecting the level of fluid collecting in said reservoir;

(c) closing said first and second valves, whenever the detected level is full in said reservoir, to evacuate the fluid in said reservoir through said third reservoir port to return the escaping fluid the main fluid system;

(d) opening said first and second valves whenever the detected level is empty in said reservoir; and (e) repeating steps (a)–(d).

16. The method of claim 15 wherein said step of detecting the level of fluid collecting in said reservoir comprises:

(a) providing a valve controller for controlling said first and second valves;

(b) providing a first electrical switch adjacent the bottom of said reservoir;

(c) providing a second electrical switch adjacent the top of said reservoir;

(d) providing a magnetic float that is moved by the fluid collecting in said reservoir wherein said magnetic float electromagnetically couples to said first electrical switch when said reservoir is empty and wherein said magnetic float electromagnetically couples to said second electrical switch whenever said reservoir is full;

(e) transmitting a first electrical signal to said valve controller whenever said first electrical switch is electromagnetically coupled to said magnetic float and transmitting a second electrical signal to said valve controller whenever said second electrical switch is electromagnetically coupled to said magnetic float.

17. The method of claim 14 wherein said lumen comprises a Venturi tube.

18. A method for transferring fluid from at least one source fluid system having a predictable flow to a destination fluid system, said method comprising the steps of:

(a) providing an air pressure source that delivers an air stream;

(b) coupling a lumen to said air pressure source, said lumen conveying said air stream from an upstream port of said lumen toward a downstream port of said lumen, said lumen including an orifice in the surface of said lumen located between said upstream port and said downstream port;

(c) coupling a first valve in fluid communication with said downstream port for opening and closing off said downstream port;

(d) coupling a first port of a reservoir to said orifice without exposing said lumen to the fluid;

(e) coupling a second port of said reservoir in fluid communication with a second valve that is in fluid communication with the at least one source fluid system; and (f) controlling the operation of said first valve and said second valve to collect fluid from the at least one source fluid system into said reservoir through said second port and then to transfer the collected fluid to the destination fluid system through a third reservoir port.

19. The method of claim 18 wherein said step of controlling the operation of said first valve and said second valve comprises:

(a) opening said first and second valves to draw fluid from the at least one source fluid system into said reservoir through said second reservoir port;

(b) closing said first and second valves to evacuate the fluid in said reservoir through said third reservoir port to transfer the fluid to the destination fluid system;

(c) opening said first and second valves; and (d) repeating steps (a)–(c).

20. The method of claim 18 wherein said lumen comprises a Venturi tube.

* * * * *